US009525948B2

(12) United States Patent
Park et al.

(10) Patent No.: US 9,525,948 B2
(45) Date of Patent: Dec. 20, 2016

(54) ELECTRO-ACOUSTIC TRANSDUCER

(71) Applicant: SAMSUNG ELECTRONICS CO., LTD., Suwon-si (KR)

(72) Inventors: Sang-ha Park, Seoul (KR); Sung-chan Kang, Hwaseong-si (KR); Dong-kyun Kim, Suwon-si (KR); Seog-woo Hong, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/262,988

(22) Filed: Apr. 28, 2014

(65) Prior Publication Data

US 2015/0139452 A1 May 21, 2015

(30) Foreign Application Priority Data

Nov. 20, 2013 (KR) ..... 10-2013-0141752

(51) Int. Cl.
*H04R 25/00* (2006.01)
*H04R 23/00* (2006.01)

(52) U.S. Cl.
CPC ..... *H04R 23/00* (2013.01); *H04R 2201/003* (2013.01)

(58) Field of Classification Search
CPC ..... H02N 11/00; H01L 41/22; H01L 41/08; H04R 19/00; B06B 1/0292
USPC ..... 381/150, 151, 369, 386, 398, 174, 175,381/191; 310/309, 310; 600/459, 437; 73/718, 73/514.32
See application file for complete search history.

(56) References Cited

U.S. PATENT DOCUMENTS 7,615,834 B2 11/2009 Khuri-Yakub et al.
2001/0043028 A1* 11/2001 Ladabaum ..... B06B 1/0292 310/334
2006/0125348 A1* 6/2006 Smith et al. ..... 310/309
2007/0215964 A1 9/2007 Khuri-Yakub et al.
2008/0184549 A1* 8/2008 Nguyen-Dinh ..... B06B 1/0292 29/594
2008/0259725 A1* 10/2008 Bayram ..... B06B 1/0292 367/7
2009/0181441 A1* 7/2009 Jin ..... C12N 11/08 435/180
2010/0137718 A1* 6/2010 Pappalardo et al. ..... 600/459
2010/0225200 A1* 9/2010 Kupnik ..... B06B 1/0292 310/300
2010/0300208 A1* 12/2010 Fujii ..... G01H 11/06 73/724
2012/0010538 A1 1/2012 Dirksen
2012/0256520 A1* 10/2012 Torashima ..... H01L 41/0815 310/300

(Continued)

FOREIGN PATENT DOCUMENTS

JP 2000-50392 A 2/2000
JP 2004-6664 A 1/2004

(Continued)

*Primary Examiner* — Curtis Kuntz
*Assistant Examiner* — Julie X Dang
(74) *Attorney, Agent, or Firm* — Sughrue Mion, PLLC

(57) ABSTRACT

An electro-acoustic transducer includes a plurality of elements that each includes a plurality of cells. The plurality of cells includes at least two membranes that have different thicknesses. The respective frequency bands of the plurality of elements are broader than respective frequency bands of the plurality of cells that configure the plurality of elements.

18 Claims, 6 Drawing Sheets

(56) References Cited

U.S. PATENT DOCUMENTS

2014/0270271 A1* 9/2014 Dehe ..... B81B 3/0018
381/174

FOREIGN PATENT DOCUMENTS

KR 10-2005-0070252 A 7/2005
KR 10-2011-0119828 A 11/2011

* cited by examiner

ELECTRO-ACOUSTIC TRANSDUCER

CROSS-REFERENCE TO RELATED PATENT APPLICATION

This application claims priority from Korean Patent Application No. 10-2013-0141752, filed on Nov. 20, 2013, in the Korean Intellectual Property Office, the disclosure of which is incorporated herein in its entirety by reference.

BACKGROUND

1. Field

The present disclosure relates to an electro-acoustic transducer, and more particularly, to a micro-machined electro-acoustic transducer.

2. Description of the Related Art

An electro-acoustic transducer is a device that converts electric energy into acoustic energy or vice versa, and may include an ultrasonic transducer, a microphone, and the like. A micro-machined electro-acoustic transducer includes a micro-electro-mechanical system (MEMS), and a typical example thereof is a micro-machined ultrasonic transducer (MUT). The MUT is a device that converts electric signals into ultrasonic signals or vice versa, and may be classified into a piezoelectric MUT (pMUT), a capacitive MUT (cMUT), a magnetic MUT (mMUT), and the like, according to a converting method of the MUT. Generally, the pMUT has been mainly used, but recently, as the cMUT has been developed, cMUT applications have increased. The cMUT is advantageous in terms of the transmission and reception of broadband signals, integrated manufacturing by using semiconductor processing, and integration with electric circuits. The cMUT is preferred to manufacture medical diagnostic imaging devices and sensors.

Recently, ultrasound devices having broadband characteristics have been actively developed due to an increased demand for various methods of obtaining ultrasound images, such as B-mode imaging, Doppler imaging, harmonic imaging, photoacoustic imaging, and the like. Such ultrasound devices are also necessary for diagnosing organs having different sizes and depth, such as the abdomen, heart, and thyroid. Although the cMUT may transmit and receive signals of a broader frequency band than a general pMUT, the cMUT may not be capable of receiving signals in the entire frequency band. Therefore, methods of combining cells with different resonant frequencies to manufacture electro-acoustic transducers with broadband characteristics are under development.

SUMMARY

Exemplary embodiments may address at least the above problems and/or disadvantages and other disadvantages not described above. Also, the exemplary embodiments are not required to overcome the disadvantages described above, and an exemplary embodiment may not overcome any of the problems described above.

One or more of exemplary embodiments provide a micro-machined electro-acoustic transducer.

According to an exemplary embodiment, an electro-acoustic transducer includes a plurality of elements. Each of the plurality of elements includes a plurality of cells, and the plurality of cells include at least two membranes that have different thicknesses.

Respective frequency bands of the plurality of elements may be broader than respective frequency bands of the plurality of cells of the plurality of elements.

The plurality of cells may each include a substrate, a support that has a cavity and is provided on the substrate, a membrane provided to cover the cavity, and an electrode provided on a top surface of the membrane.

The substrate may include a conductive material. For example, the substrate may include low resistivity silicon having a specific electrical resistance of 0.01 Ωcm or less. An insulating layer may be further provided on the substrate. The membrane may include, for example, silicon.

The plurality of elements and the plurality of cells may be two-dimensionally arrayed. The plurality of cells may have the same size. The electro-acoustic transducer may include a capacitive micro-machined ultrasound transducer (cMUT).

According to an exemplary embodiment, an element of an electro-acoustic transducer, the element includes a plurality of cells, and the plurality of cells may include at least two membranes that have different thicknesses.

BRIEF DESCRIPTION OF THE DRAWINGS

The above and/or other aspects will become more apparent by describing certain exemplary embodiments, with reference to the accompanying drawings, in which.

DETAILED DESCRIPTION

Figure 1:
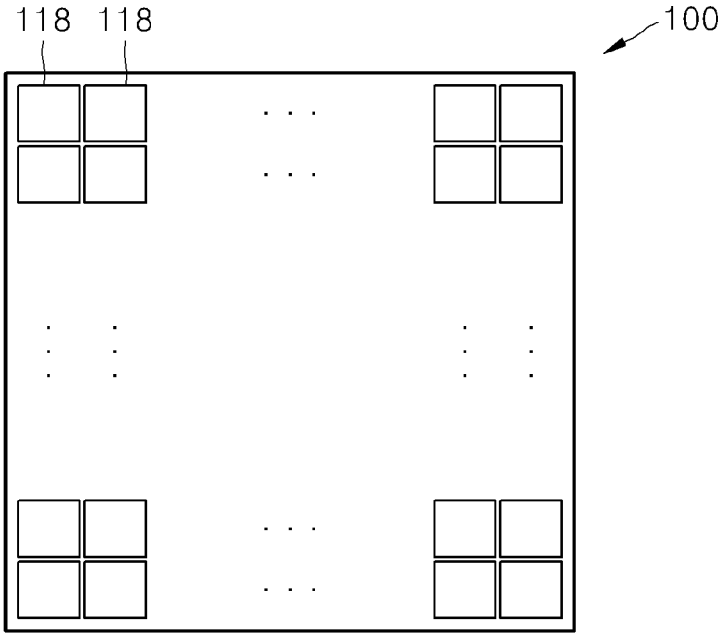
FIG. 1 is a plan view of a transducer chip of an electro-acoustic transducer according to an exemplary embodiment.

Certain exemplary embodiments are described in greater detail below with reference to the accompanying drawings.

In the following description, the same drawing reference numerals are used for the same elements even in different drawings. The matters defined in the description, such as detailed construction and elements, are provided to assist in a comprehensive understanding of exemplary embodiments. Thus, it is apparent that exemplary embodiments can be carried out without those specifically defined matters. Also, well-known functions or constructions are not described in detail since they would obscure exemplary embodiments with unnecessary detail.

It will be understood that when a predetermined material layer is referred to as being "formed on" a substrate or another layer, the predetermined material layer can be directly or indirectly formed on the substrate or the other layer. That is, an intervening layer may be present between the predetermined layer and the substrate or the other layer.

It will be understood that respective materials consisting layers of the embodiments described below are merely provided as examples, and accordingly, other materials may be used.

Expressions such as "at least one of," when preceding a list of elements, modify the entire list of elements and do not modify the individual elements of the list.

FIG. 1 is a plan view of a transducer chip 100 of an electro-acoustic transducer according to an exemplary embodiment of the present invention. The electro-acoustic transducer may include a plurality of transducer chips 100. FIG. 1 illustrates the transducer chip 100 among the plurality of transducer chips 100 that are included in the electro-acoustic transducer. The electro-acoustic transducer may be, for example, a capacitive micro-machined ultrasound transducer (cMUT). Referring to FIG. 1, the transducer chip 100 may include a plurality of elements 118 that are arrayed two-dimensionally. The elements 118 may be driven independently. The elements 118 may have the same frequency characteristic, but an exemplary embodiment is not limited to, and at least some of the elements 118 may have different frequency characteristics. Also, each of the elements 118 includes a plurality of cells 111 that are arrayed two-dimensionally. The cells 111 may have the same size.

Figure 2:
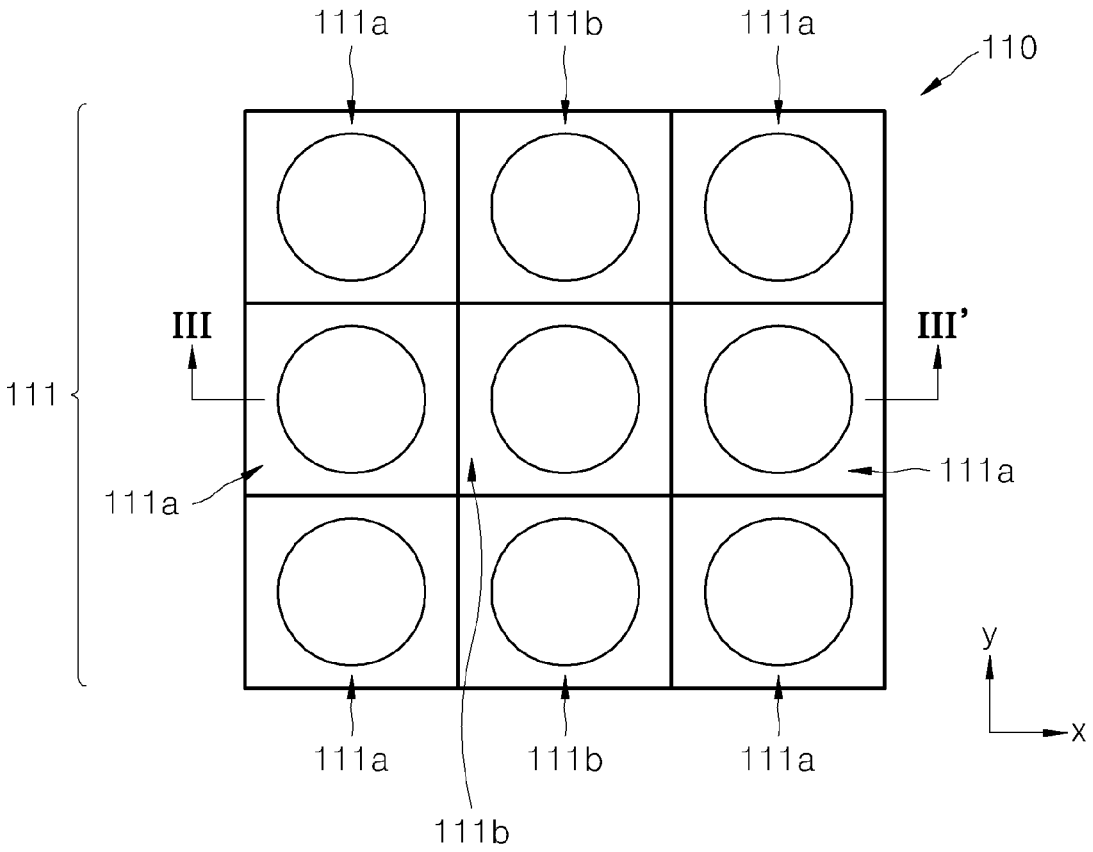
FIG. 2 is a plan view of an element illustrated in FIG. 1.

FIG. 2 is a plan view of one of the elements 118 illustrated in FIG. 1.

Referring to FIG. 2, an element 110 includes the plurality of cells 111 that are arrayed two-dimensionally. FIG. 2 illustrates a case where the element 110 includes nine cells 111 that are arrayed to form a square. However, this case is merely provided as an example, and the number and an array shape of the cells 111 may be modified in various ways. The element 110 may include at least one first cell 111*a* and at least one second cell 111*b* which have different frequency characteristics (i.e., resonant frequency). FIG. 2 illustrates a case where the element 110 includes six first cells 111*a* and three second cells 111*b*. The first and second cells 111*a* and 111*b* are alternately arrayed in the X-direction. However, this case is merely an example, and the number and an array form of the first and second cells 111*a* and 111*b* may be modified in various ways. As described below, the first and second cells 111*a* and 111*b* may respectively include first and second membranes 115*a* and 115*b* which have different thicknesses. Accordingly, when the element 110 of the electro-acoustic transducer is configured by using the first and second cells 111*a* and 111*b* which respectively include the first and second membranes 115*a* and 115*b* having different thicknesses, a frequency band of the element 110 may be broader than respective frequency bands of the first and second cells 111*a* and 111*b*. Sizes of the first and second cells 111*a* and 111*b* configuring the element 110 may be the same, i.e., as seen in a top view of FIG. 2. That is, respective radiuses of the first and second cells 111*a* and 111*b* may be the same.

Figure 3:
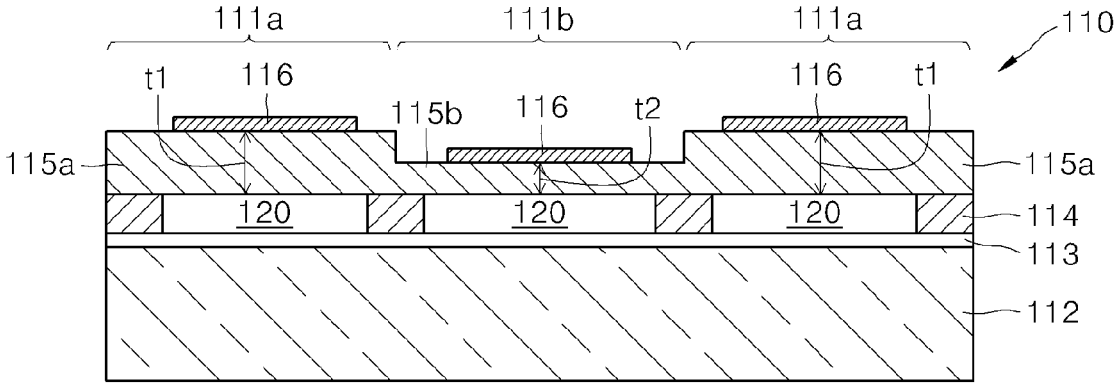
FIG. 3 is a cross-sectional view of the element that is cut along the line III-III' of FIG. 2.
Figure 4:
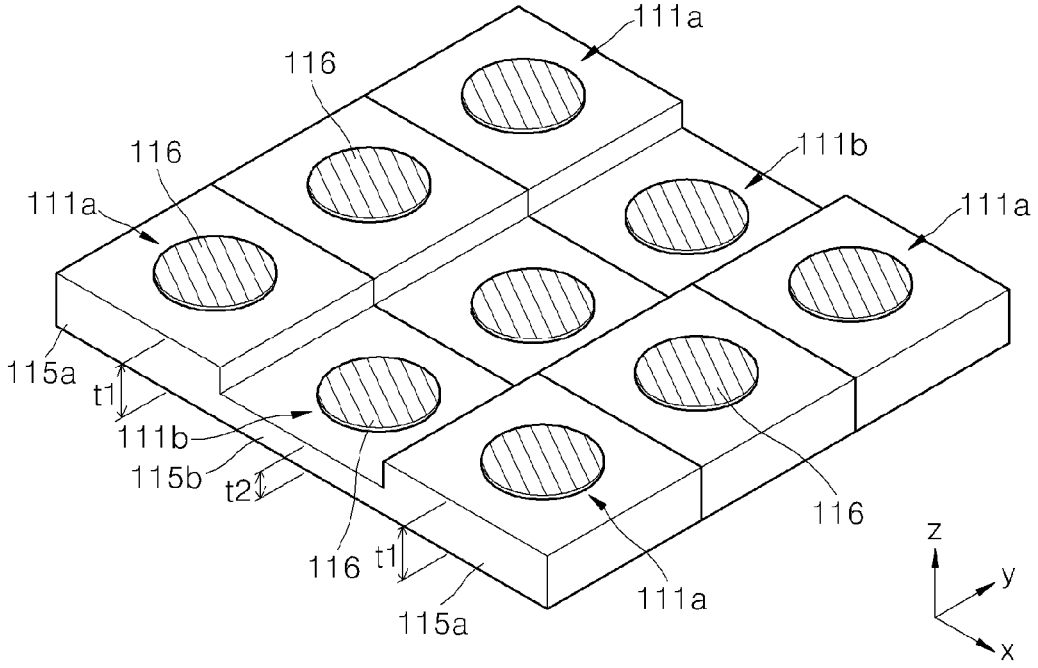
FIG. 4 is a perspective view of membranes illustrated in FIG. 3.

FIG. 3 is a cross-sectional view of the element 110 that is cut along the line III-III' of FIG. 2. FIG. 4 is a perspective view of the first and second membranes 115*a* and 115*b* illustrated in FIG. 3.

Referring to FIGS. 3 and 4, the first cell 111*a* includes a substrate 112, a support 114 provided on the substrate 112, the first membrane 115*a* provided on the support 114, and an electrode 116 provided on the first membrane 115*a*. The substrate 112 may function as a lower electrode. Therefore, the substrate 112 may include a conductive material. For example, the substrate 112 may include, but is not limited to, low resistivity silicon having a specific electrical resistance of about 0.01 Ωcm or less. An insulating layer 113 formed of, for example, silicon oxide, may be further provided on a top surface of the substrate 112.

The support 114 including a cavity 120 is provided on the insulating layer 113. The support 114 may include, but is not limited to, silicon oxide. The first membrane 115*a* is provided on the support 114 to cover the cavity 120. The first membrane 115*a* may include, but is not limited to, silicon. In this case, the first membrane 115*a* may have a first thickness t1 that differs from a second thickness t2 of the second membrane 115*b* that is described below. Also, the electrode 116 is provided on a top surface of the first membrane 115*a*. The electrode 116 functions as an upper electrode, and may include, but is not limited to, metal.

The second cell 111*b* includes the substrate 112, the support 114 that includes the cavity 120 and is provided on the substrate 112, the second membrane 115*b* provided on the support 114 to cover the cavity 120, and the electrode 116 provided on the second membrane 115*b*. Since the substrate 112, the support 114, and the electrode 116 are described above, descriptions thereof will be omitted. The second membrane 115*b* has the second thickness t2 that differs from the first thickness t1 of the first membrane 115*a*. FIG. 3 illustrates a case where the second thickness t2 of the second membrane 115*b* is less than the first thickness t1 of the first membrane 115*a*. The second membrane 115*b* may include the same material as the first membrane 115*a*, such as silicon. FIG. 4 illustrates a case where the first and second membranes 115*a* and 115*b* having different thicknesses are alternately arrayed in the X-direction.

As described above, the element 110 of the electro-acoustic transducer is configured by using the at least one first cell 111*a* and the at least one second cell 111*b* which have different frequency characteristics. In this case, the first and second cells 111*a* and 111*b* respectively include the first and second membranes 115*a* and 115*b* which have different thicknesses. Therefore, the electro-acoustic transducer has a broadband frequency characteristic.

In general, a resonant frequency fc of a cell in a cMUT is defined by Equation 1.

$$f_c = \frac{(2.4)^2}{2\pi}\sqrt{\frac{Y_o}{12\rho(1-\delta^2)}}\,\frac{t_n}{a^2} \qquad \text{[Equation 1]}$$

where $Y_0$, ρ, and δ respectively indicate a Young's modulus, a density, and a Poisson's ratio of a membrane. Also, $t_n$ and a respectively indicate a thickness of the membrane and a radius of the cell.

Referring to Equation 1, it may be understood that the resonant frequency $f_c$ of the cell may be modified by changing the radius of the cell. Accordingly, an element of the electro-acoustic transducer having a broadband property may be manufactured by combining cells that have different resonant frequencies by changing the radius of the cell. In this case, however, not only it is difficult to uniformly dispose various sized cells in a limited area, but also, the cells may not be efficiently disposed. In an exemplary embodiment, the electro-acoustic transducer is manufactured by combining the first and second cells 111*a* and 111*b* that have different frequency characteristics by changing the respective thicknesses of the membranes. Accordingly, the electro-acoustic transducer has broadband frequency characteristics.

Figure 5:
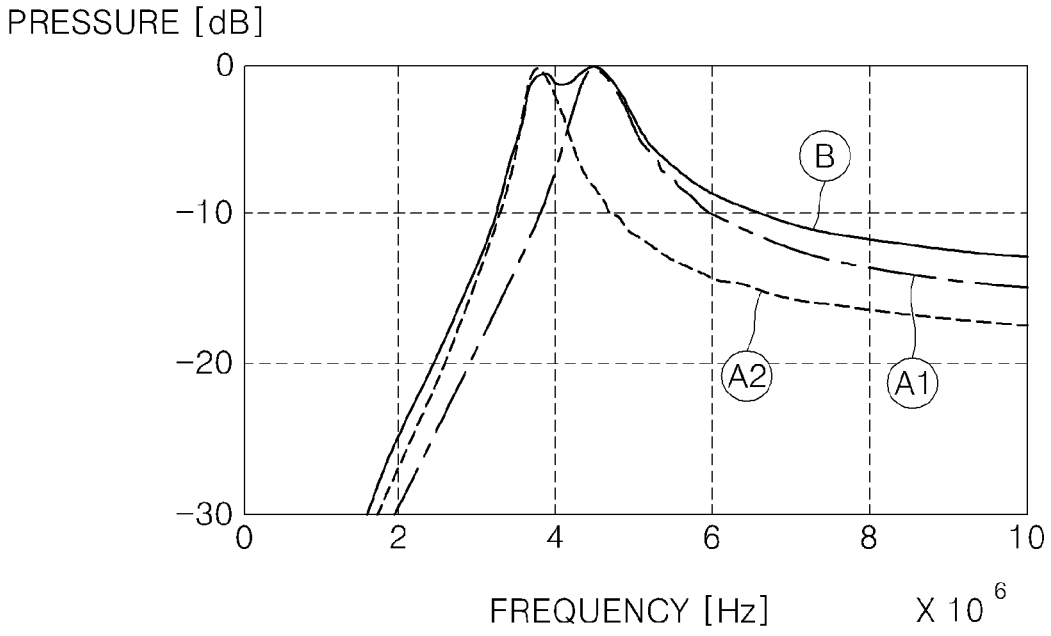
FIG. 5 is a graph for comparing a frequency characteristic of an electro-acoustic transducer that is configured of cells including membranes that have the same thickness, and an electro-acoustic transducer having two types of cells including membranes that have different thickness.

FIG. 5 is a graph for comparing a frequency characteristic of an electro-acoustic transducer having cells including membranes that have the same thickness and an electro-acoustic transducer having two types of cells including membranes that have different thickness. In FIG. 5, A1 is a line showing a frequency characteristic of an element having cells including membranes that have the first thickness t1, A2 is a line showing a frequency characteristic of an element having cells including membranes that have the second thickness t2 (<t1). It may be understood that a resonant frequency of the element including the cells including the membranes that have the first thickness t1 is higher than that of the element including the cells including the membranes that have the second thickness t2 (<t1). In addition, B is a line showing a frequency characteristic of an element that is manufactured by combining the cells including the membranes that have the first thickness t1 and the cells including the membranes that have the second thickness t2. When an element is manufactured by combining two cells having different resonant frequencies, frequency bands of the two cells overlap, and thus, the element has a frequency characteristic in a frequency band broader than respective frequency bands of the two cells. Accordingly, in an exemplary embodiment, the electro-acoustic transducer having a broadband frequency characteristic is manufactured by combining the at least one first cell 111*a* and the at least one second cell 111*b* that have different frequency properties by changing respective thicknesses of the membranes.

FIG. 2 illustrates a case where the first and second cells 111*a* and 111*b* which have different frequency properties and configure the element 110 of the electro-acoustic transducer are alternately arrayed in the X-direction. However, the embodiments of the present invention are not limited thereto, and the number and array form of the first and second cells 111*a* and 111*b* may be modified in various ways.

Figure 6:
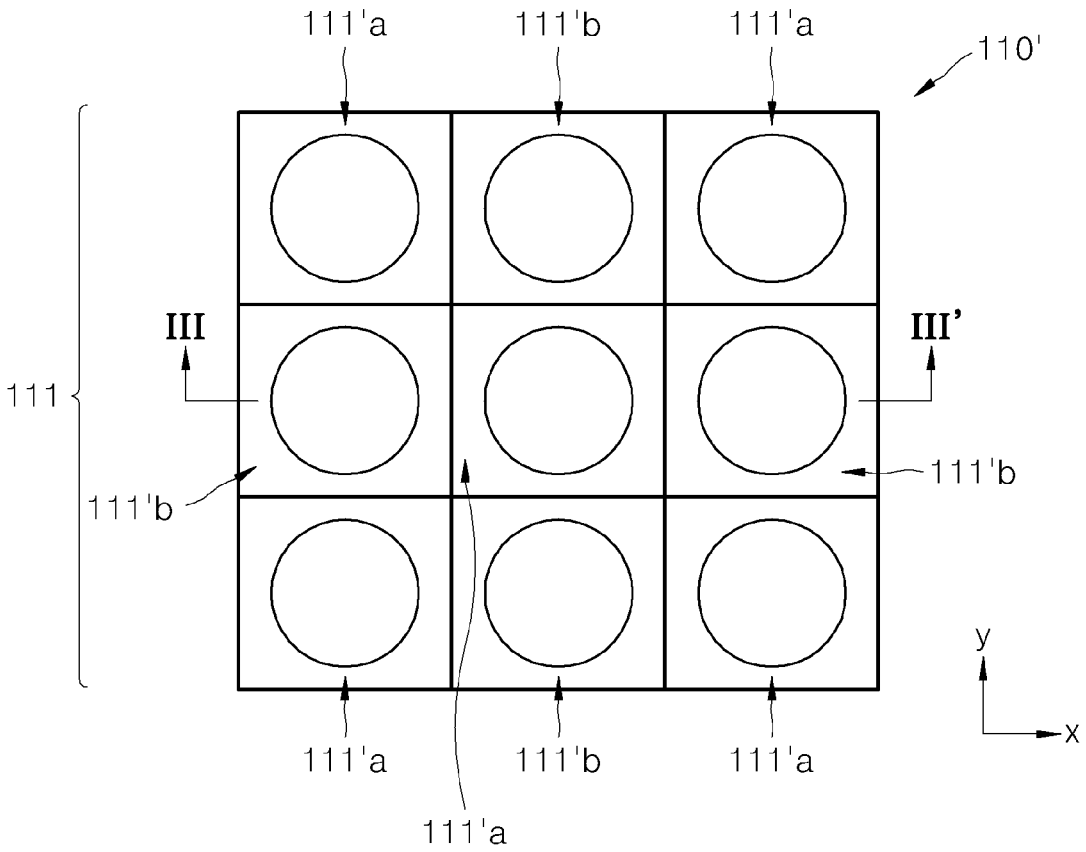
FIG. 6 is a plan view of a modified example of the element illustrated in FIG. 2.
Figure 7:
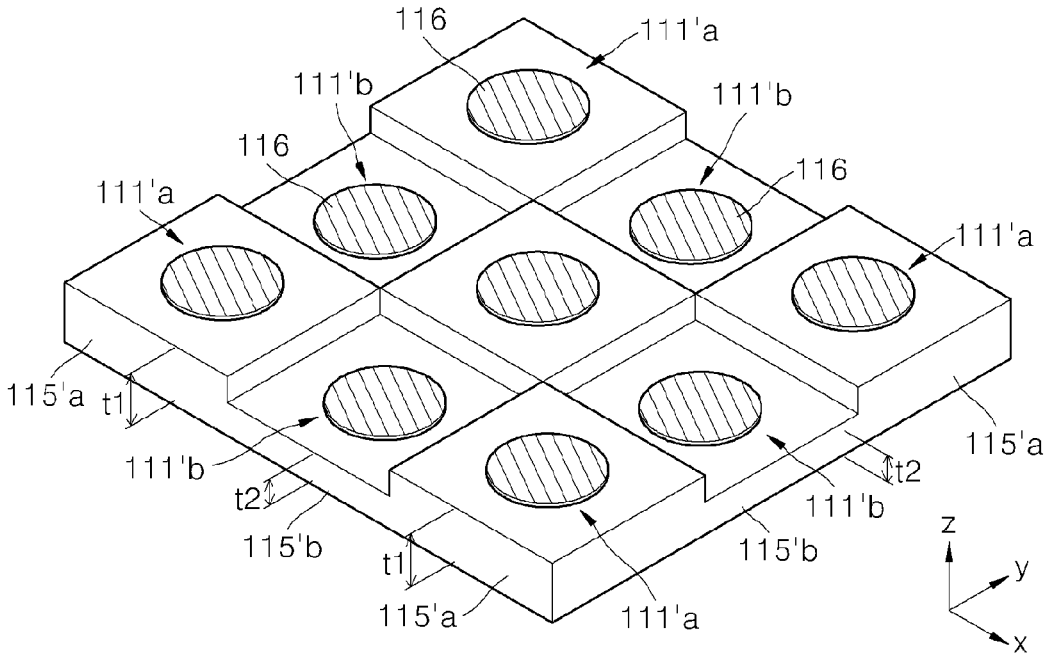
FIG. 7 is a perspective view of membranes that configure cells illustrated in FIG. 6.

FIG. 6 is a plan view of an element 110' which is a modified example of the element 110 illustrated in FIG. 2. FIG. 7 is a perspective view of first and second membranes 115'*a* and 115'*b* that configure a plurality of cells 111' illustrated in FIG. 6.

Referring to FIGS. 6 and 7, the element 110' of the electro-acoustic transducer includes the plurality of cells 111' that are two-dimensionally arrayed. In this case, the element 110' may include at least one first cell 111'*a* and at least one second cell 111'*b* that have different frequency characteristics. FIG. 6 illustrates a case where the element 110' has five first cells 111'*a* and four second cells 111'*b*, which are alternately respectively arrayed in the X-direction and the Y-direction. The first cell 111'*a* includes the first membrane 115'*a* that has a first thickness t1, and the second cell 111'*b* includes the second membrane 115'*b* that has the second thickness t2. Accordingly, when the element 110' of the electro-acoustic transducer is manufactured by combining the first and second cells 111'*a* and 111'*b* which have different frequency characteristics, a broadband frequency characteristic may be obtained as described above. The number and array shape of the first and second cells 111'*a* and 111'*b* are merely provided as an example in the description above, and the number and array shape may be modified in various ways.

Figure 8:
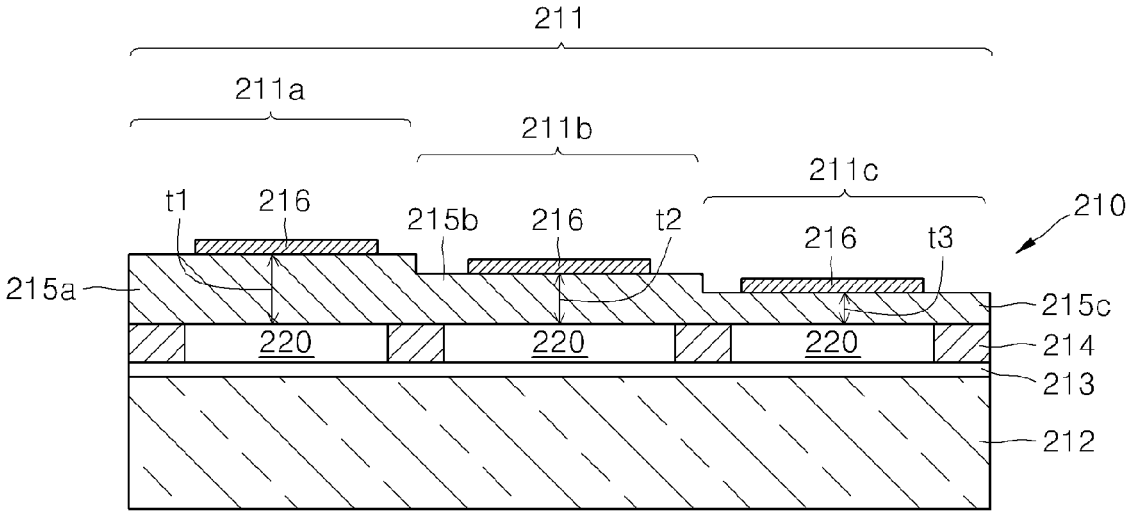
FIG. 8 is a cross-sectional view of the element of the electro-acoustic transducer, according to an exemplary embodiment.

FIG. 8 is a cross-sectional view of an element 210 of the electro-acoustic transducer, according to an exemplary embodiment. FIG. 8 illustrates a case where the element 210 includes first, second, and third cells 211*a*, 211*b*, and 211*c* which have different thicknesses. The element 210 may be one of a plurality of elements of the electro-acoustic transducer 100.

Referring to FIG. 8, the element 210 includes a plurality of cells 211 that are two-dimensionally arrayed. The number and array shape of the plurality of cells 211 in the element 210 may be modified in various ways. The element 210 may include at least one first cell 211*a*, at least one second cell 211*b*, and at least one third cell 211*c* which have different frequency characteristics (i.e., resonant frequency). The number and arrays of the first, second, and third cells 211*a*, 211*b*, and 211*c* may be modified in various ways.

The first, second, and third cells 211*a*, 211*b*, and 211*c* respectively include first, second, and third membranes 215*a*, 215*b*, and 215*c* which have different thicknesses. When the element 210 of the electro-acoustic transducer is configured of the first, second, and third cells 211*a*, 211*b*, and 211*c* which respectively include the first, second, and third membranes 215*a*, 215*b*, and 215*c* which have different thicknesses, a frequency band of the element 210 may be broader than respective frequency bands of the first, second, and third cells 211*a*, 211*b*, and 211*c*. Sizes of the first, second, and third cells 211*a*, 211*b*, and 211*c* that configure the element 210 may be the same. That is, respective radiuses of the first, second, and third cells 211*a*, 211*b*, and 211*c* may be the same.

The first cell 211*a* includes a substrate 212, a support 214 provided on the substrate 212, the first membrane 215*a* provided on the support 214, and an electrode 216 provided on the first membrane 215*a*. The substrate 212 may function as a lower electrode, and therefore, the substrate 112 may include a conductive material. For example, the substrate 212 may include, but is not limited to, low resistivity silicon having a specific electrical resistance of about 0.01 Ωcm or less. An insulating layer 213, which is formed of, for example, silicon oxide, may be further provided on a top surface of the substrate 212.

The support 214 including a cavity is provided on the insulating layer 213. The support 214 may include, but is not limited to, silicon oxide. The first membrane 215*a* is provided on the support 214 to cover the cavity 220. The first membrane 215*a* may include, but is not limited to, silicon. In this case, the first membrane 215*a* may have a first thickness t1 that differs from second and third thicknesses t2 and t3 of the second and third membranes 215*b* and 215*c*. Also, the electrode 216 is provided on a top surface of the first membrane 215*a*. The electrode 216 functions as an upper electrode, and may include, but is not limited to, metal.

The second cell 211*b* includes the substrate 212, the support 214 that includes the cavity 220 and is provided on the substrate 212, the second membrane 215*b* provided on the support 214 to cover the cavity 220, and the electrode 216 provided on the second membrane 215*b*. Since the substrate 212, the support 214, and the electrode 216 are described above, descriptions thereof will be omitted. The second membrane 215*b* has the second thickness t2 that differs from the first and third thicknesses t1 and t3 of the first and third membranes 215*a* and 215*c*. FIG. 8 illustrates a case where the second thickness t2 of the second membrane 215*b* is less than the first thickness t1 of the first membrane 215*a*. The second membrane 215*b* may include the same material as the first membrane 215*a*, such as silicon.

The third cell 211*c* includes the substrate 212, the support 214 that includes the cavity 220 and is provided on the substrate 212, the third membrane 215*c* that is provided on the support 214 to cover the cavity 220, and the electrode 216 provided on the third membrane 215*c*. Since the substrate 212, the support 214, and the electrode 216 are described above, descriptions thereof will be omitted. The third membrane 215*c* has the third thickness t3 that differs from the first and second thicknesses t1 and t2 of the first and second membranes 215*a* and 215*b*. FIG. 8 illustrates a case where the third thickness t3 of the third membrane 215*c* is less than the second thickness t2 of the second membrane 215*b*. The third membrane 215*c* may include the same material as the first and second membranes 215*a* and 215*b*, such as silicon.

As described above, in an exemplary embodiment, the element 210 of the electro-acoustic transducer is configured by using the first, second, and third cells 211*a*, 211*b*, and 211*c* which have different frequency characteristics. In this case, the first, second, and third cells 211*a*, 211*b*, and 211*c* respectively include the first, second, and third membranes 215*a*, 215*b*, and 215*c* which have different thicknesses. Therefore, when the element 210 of the electro-acoustic transducer is manufactured by combining the first, second, and third cells 211*a*, 211*b*, and 211*c* which have different frequency properties, a broadband frequency characteristic may be obtained, as described above. Although in the embodiment described above, the element 210 includes the first, second, and third cells 211*a*, 211*b*, and 211*c* which have different frequency characteristics, the embodiments of the present invention are not limited thereto and an element may include four or more cells that have different frequency characteristics As described above, according to the one or more of the above embodiments of the present invention, when an electro-acoustic transducer is manufactured, a thickness of a membrane may be changed to manufacture cells that have different frequency characteristics, and then, the cells may be combined to manufacture an element having a broadband frequency characteristic. The electro-acoustic transducer that includes elements having broadband frequency characteristics may be used in ultrasound devices for obtaining ultrasound images by using various methods, such as B-mode imaging, Doppler imaging, harmonic imaging, photoacoustic imaging, and the like, and for diagnosing organs having different sizes and depth, such as the abdomen, heart, and thyroid.

It should be understood that the exemplary embodiments described therein should be considered in a descriptive sense only and not for purposes of limitation. Descriptions of features or aspects within each embodiment should typically be considered as available for other similar features or aspects in other embodiments.

The foregoing exemplary embodiments and advantages are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. An electro-acoustic transducer comprising:
- a plurality of elements, each of the plurality of elements comprising:
- a substrate;
- a first cell comprising:
  - a first support having a first cavity and disposed on the substrate;
  - a first membrane disposed on the first support and the first cavity and having a first thickness; and
  - a first electrode disposed on the first membrane; and
- a second cell comprising:
  - a second support having a second cavity and disposed on the substrate;
  - a second membrane disposed on the second support and the second cavity and having a second thickness different from the first thickness; and
  - a second electrode disposed oil the second membrane.

2. The electro-acoustic transducer of claim 1, wherein respective frequency bands of the plurality of elements are broader than respective frequency bands of the first cell and the second cell.

3. The electro-acoustic transducer of claim 1, wherein the substrate comprises a conductive material.

4. The electro-acoustic transducer of claim 3, wherein the substrate comprises low resistivity silicon.

5. The electro-acoustic transducer of claim 4, wherein a specific electrical resistance of the low resistivity silicon is 0.01 Ωcm or less.

6. The electro-acoustic transducer of claim 1, wherein each of the first cell and the second cell further comprises an insulating layer disposed on the substrate.

7. The electro-acoustic transducer of claim 1, wherein each of the first membrane and the second membrane comprises silicon.

8. The electro-acoustic transducer of claim 1, wherein the plurality of elements, the first cell, and the second cell are two-dimensionally arrayed.

9. The electro-acoustic transducer of claim 1, wherein each of the first cell and the second cell has a same size.

10. The electro-acoustic transducer of claim 1, wherein the electro-acoustic transducer comprises a capacitive micro-machined ultrasound transducer (cMUT).

11. An element of an electro-acoustic transducer, the element comprising:
- a substrate;
- a first cell comprising:
  - a first support having a first cavity and disposed on the substrate;
  - a first membrane disposed on the first support and the first cavity and having a first thickness; and
  - a first electrode disposed on the first membrane; and
- a second cell comprising:
  - a second support having a second cavity and disposed on the substrate;
  - a second membrane disposed on the second support and the second cavity and having a second thickness different from the first thickness; and
  - a second electrode disposed on the second membrane.

12. The element of claim 11, wherein a frequency band of the element is broader than respective frequency bands of the first cell and the second cell.

13. The element of claim 11, wherein the substrate comprises a conductive material.

14. The element of claim 13, wherein the substrate comprises low resistivity silicon.

15. The element of claim 11, wherein each of the first cell and the second cell further comprises an insulating layer disposed on the substrate.

16. The element of claim 11, wherein each of the first membrane and the second membrane comprises silicon.

17. The element of claim 11, wherein the first cell and the second cell are two-dimensionally arrayed.

18. The element of claim 17, wherein each of the first cell and the second cell has a same size.

* * * * *